United States Patent [19]

Phillips, Jr. et al.

[11] Patent Number: 4,823,407

[45] Date of Patent: Apr. 25, 1989

[54] HEADWEAR WITH FACE TUNNEL FOR COLD WEATHER ENVIRONMENT

[75] Inventors: James G. Phillips, Jr., Pleasant Grove; Joanne Harlow, Orem, both of Utah; James M. Clanton, Camp Hill, Ala.

[73] Assignee: Burlington Industries, Inc., Greensboro, N.C.

[21] Appl. No.: 52,989

[22] Filed: May 22, 1987

[51] Int. Cl.[4] ..... A42B 1/04

[52] U.S. Cl. ..... 2/202; 2/205; 2/84

[58] Field of Search ..... 2/9, 426, 202, 203, 2/204, 205 X, 206, 84 X

[56] References Cited

U.S. PATENT DOCUMENTS

| | | | |
|---|---|---|---|
| 1,139,675 | 5/1915 | Harris et al. . | |
| 2,282,334 | 5/1942 | MacVaugh | 2/9 |
| 2,376,345 | 5/1945 | Daiber | 2/202 |
| 2,625,684 | 1/1953 | Magnusson | 2/9 |
| 2,686,317 | 8/1954 | Michaelis | 2/205 |
| 2,839,757 | 6/1958 | Gianola | 2/205 |
| 2,870,451 | 1/1959 | Brodsky | 2/202 |
| 2,870,452 | 1/1959 | De Grazia | 2/203 |
| 3,242,500 | 3/1966 | Derr | 2/3 |
| 3,440,660 | 4/1969 | Krinke | 2/3 |
| 3,789,428 | 2/1974 | Martin | 2/9 |
| 4,573,217 | 3/1986 | Reed | 2/7 |
| 4,593,417 | 6/1986 | Brown, Jr. et al. | 2/209 |

FOREIGN PATENT DOCUMENTS

| | | |
|---|---|---|
| 493674 | 6/1950 | Belgium . |
| 1089472 | 3/1955 | France . |

OTHER PUBLICATIONS

"First with Polyfoam," Ocate Corporation, 1969.

"Backpacking," R. C. Rethmel, Appendix pp. A-22 and A-23.

"Clues and Clothing for Snow Survival," E. P. Haddon, *Popular Mechanics*, pp. 104–107, Nov. 1969.

*Primary Examiner*—Henry S. Jaudon

*Attorney, Agent, or Firm*—Nixon & Vanderhye

[57] ABSTRACT

The headwear includes a headgear formed of flexible material for comfortably encompassing the individual's head. The forward portion of the headgear has an opening to which is mounted the inner end of a face tunnel, which projects forwardly of the headgear. The headwear is formed of three layers, an inner layer, an intermediate foam layer and an outer layer. One of the inner and outer layers is formed of a high wind resistant material having high heat retention and moisture vapor transmission characteristics. In one form, the foam forming the intermediate layer of the face tunnel has a greater density than the foam forming the intermediate layer of the headgear, whereby the face tunnel is substantially rigid, stiff and self-sustaining in shape, even in the face of high winds. An access opening is provided adjacent the back of the headwear to enable it to be placed on and pulled off the individual's head.

28 Claims, 2 Drawing Sheets

HEADWEAR WITH FACE TUNNEL FOR COLD WEATHER ENVIRONMENT

BACKGROUND AND SUMMARY OF THE INVENTION

The present invention relates to headwear for protecting an individual's head and face in extreme cold and arctic wind conditions and particularly relates to headwear formed of improved materials and construction for preventing heat loss and permitting controlled transmission of moisture vapor produced by perspiration, while simultaneously providing better face protection from wind.

Layered cold weather garment systems have been used in the past. For example, one such system includes an outer or "shell" layer of nylon, having high permeability to air and moisture vapor, an intermediate layer of polyurethane open-cell foam and an interior layer or lining of woven or knit fabric. These three components are sewn together to form a unitary garment. However, such system suffers from the lack of high wind resistance. It will be appreciated that high wind resistance, particularly in the area of the individual's head and face, is essential if adequate protection against extreme arctic cold and wind conditions is to be afforded.

It is therefore necessary in such cold weather environments to provide protection for an individual's head and face in such manner that heat loss transmission is minimized, vapor moisture transmission is optimized and the effects of wind on the portions of the individual's face exposed to these harsh weather conditions is minimized. Different types of cold weater hats and hoods have been proposed and constructed in the past, certain of which have included face tunnels, in an effort to achieve these goals. One such effort provided a combination of a plastic foam hat and a plastic foam face tunnel. Wire was used as a frame for the face tunnel for retaining its shape. It will also be appreciated that hats having an outer waterproof nylon shell covering an inner foam liner have been used in the past.

While these types of headwear have been satisfactory, it has been found that additional face protection is needed inasmuch as substantial wind continues to enter the face tunnel with effect on the face and forehead. Further, while headwear with face tunnels ideally should have a certain flexibility for purposes of storing and carrying the headwear as well as for affording fit and comfort to the user, the headwear, to the extent it supports the face tunnel, and particularly the face tunnel, must be sufficiently rigid as to preclude collapse of the face tunnel under severe wind conditions. Thus, while flexibility is required in the headwear for fit and comfort, it is desirable to provide a more rigid or stiff face tunnel as an integral part of the headgear to preclude collapse in face of high wind conditions.

According to the present invention, there is provided protective headwear for cold weather environments, including headgear for enclosing an individual's head and having a margin along a front portion defining an opening for the individual's face. An access opening remote from the front portion, for example adjacent the back of the headgear, is provided for receiving the individual's head. Means are provided defining a tunnel, having opposite ends and perimetrically enclosing the tunnel between such ends, one of the ends being connected to the headgear about the margin such that the tunnel projects forwardly from the headgear. In a preferred form of the present invention, the headwear is comprised of an interior lining, an intermediate layer of foam material and an outer fabric layer, wherein one of the outer fabric layer and the interior lining comprises a fabric having an air permeability of less than 15 $ft^3$/min per $ft^2$ at 0.5 inches head of water and a moisture vapor transmission rate of at least 1,000 grams per $meter^2$ per 24 hours. Preferably, a nylon outer fabric layer is provided and the one layer constitutes the inner lining of the headwear. That particular type of three-layer system reduces heat transfer, affords optimal moisture vapor transmission and improves resistance to wind.

Additionally, the present invention affords a wind tunnel which is highly resistant to collapse under high wind conditions. To provide this, and yet afford a headgear which is flexible and comfortable in use, the intermediate foam layers of the headgear and tunnel have different densities and, hence, have different indentation load-deflection values. Thus, to achieve higher resistance to wind and a stiffer wind tunnel, the foam intermediate layer of the tunnel preferably has a density of about 1.8 lbs/$ft^3$, an indentation load-deflection of 28 pounds and a thickness of 1 inch, whereas the foam which forms the intermediate layer of the headgear has a density of about 1.1 lbs/$ft^3$, an indentation load-deflection value of 12 pounds and a thickness of 1 inch.

Further, the foam forming the tunnel acts as a structural member and provides stiffness to keep the tunnel properly shaped. The general cylindrical shape of the tunnel makes it stronger than a flat-sided member. In addition, a dart is taken in along each side of the tunnel from the base where it attaches to the headgear and outward about one-third to one-half the tunnel length. This acts as a corrugation and provides additional strength. The side darts also make the tunnel more horizontally elliptical, rather than round, affording enhanced side or peripheral vision. Without these darts, the tunnel tends to be more vertically elliptical, like a person's head, and this restricts side vision.

To further protect the individual's face in the cold weather environment, a forehead shield is provided which extends from the headgear beyond the margin adjacent the top of the face opening and partially into the area defined by the tunnel to overlie the forehead of the individual wearing the headwear. This affords addition protection against loss of heat and wind effects on the face.

An access flap is provided adjacent the back or rear portion of the headwear. Preferably, the access flap may be releasably secured by hook and loop fasteners, with a flap overlying the adjacent portion of the headgear, in a manner to not substantially reduce the integrity of the hat, induce high heat losses or permit wind penetration. The flap, of course, opens to permit the individual to don the headwear and closes such that the headwear flexibly envelops the head.

Accordingly, it is a primary object of the present invention to provide a novel and improved headwear with face tunnel having improved heat retention characteristics, wind resistance, face protection and resistance to face tunnel collapse under high wind conditions.

These and further objects and advantages of the present invention will become more apparent upon reference to the following specification, appended drawings and claims.

BRIEF DESCRIPTION OF THE DRAWING FIGURES

Figure 2:
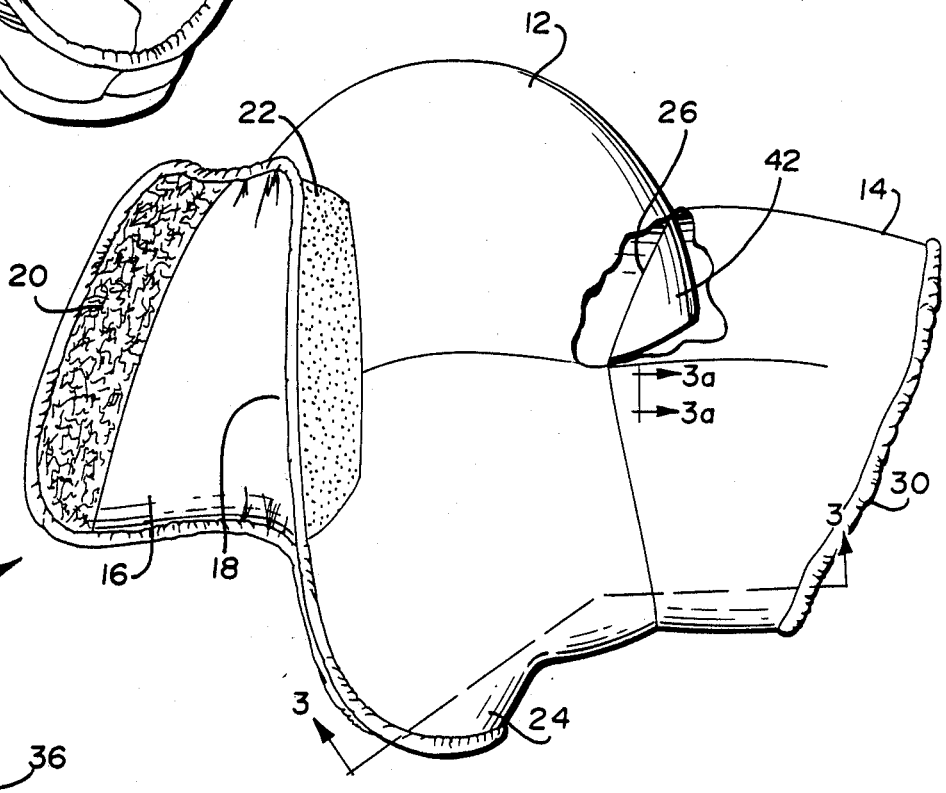
FIG. 2 is an enlarged side elevational view thereof, with parts broken out and in cross-section.
Figure 3A:
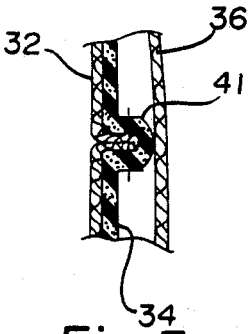
FIG. 3 is a cross-sectional view thereof taken generally about on line 3—3 in FIG. 2.
Figure 4:
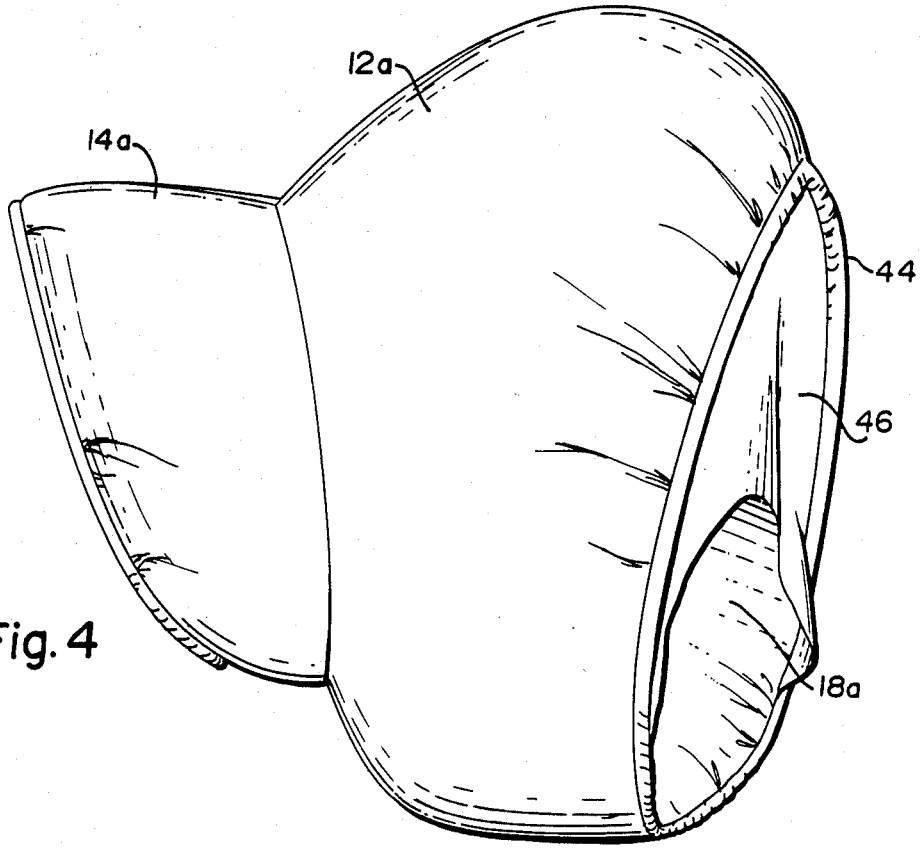
Figure 5:
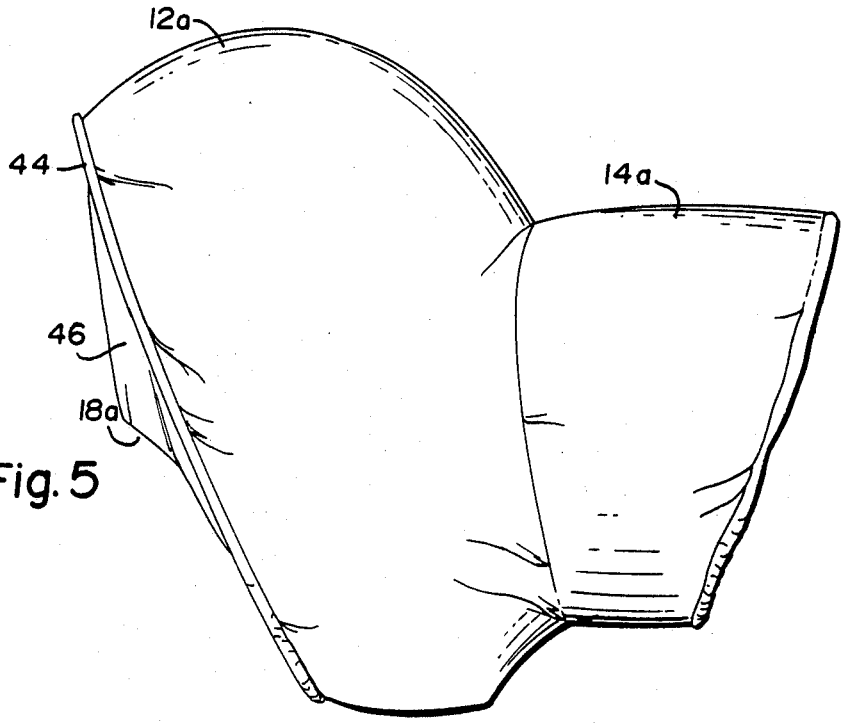

FIG. 3*a* is a cross-sectional view thereof taken generally about on line 3*a*—3*a* in FIG. 2;

FIG. 4 is a perspective view of a second embodiment of the present invention; and FIG. 5 is a side elevational view of the embodiment hereof illustrated in FIG. 4.

DETAILED DESCRIPTION OF THE DRAWING FIGURES

Reference will now be made in detail to the present preferred embodiment of the invention, an example of which is illustrated in the accompanying drawings.

Figure 1:
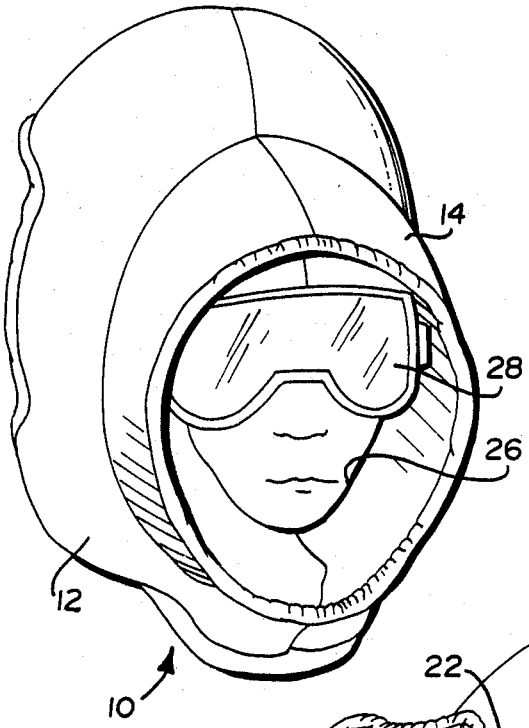
FIG. 1 is a perspective view of headwear constructed in accordance with the present invention as viewed substantially from the front of the headwear and illustrating an individual's head within the headwear.

Referring now to FIG. 1, there is illustrated headwear, generally designated 10, constructed in accordance with the present invention and including headgear 12 and a face tunnel 14 projecting from the front side of headgear 12. Headgear 12 is designed to substantially encompass the entirety of an individual's head, leaving only small portions of the wearer's face exposed, but within face tunnel 14. To enable the individual to don the headgear 12 and to accommodate different sizes, a flap 16 is provided to close off an access opening 18 formed at the rear or backside of headgear 12. The flap 16 forms an integral continuation of a side portion of headgear 12 and terminates at its distal end to overlie the opposite side portion of the headgear 12. To releasably secure the flap in a position closing access opening 18, hook and loop fasteners are provided. For example, loops 20 are formed along the inside margin of the distal end of flap 16 and hooks 22 are provided along an outside portion of the side of headgear 12 adjacent access opening 18 for receiving loops 20. Thus, headgear 12 may be pulled over an individual's head with the head being inserted through the access opening 18. It will be appreciated that access opening 18 includes an opening defined by a neck portion 24 of headgear 12. Once headgear 12 encompasses the individual's head, flap 16 may be crossed over to cover access opening 18 and thereby cover the back of the individual's head. The edge of flap 16 carrying loops 20 may then be pressed onto hooks 22 whereby the hooks and loops interact to releasably secure the flap in position, substantially closing access opening 18.

It will be appreciated from a review of FIGS. 1 and 2, that headgear 12 terminates on its front side in a margin 26 which outlines in use an individual's face, the individual illustrated in FIG. 1 being shown wearing goggles 28. Face tunnel 14 thus has an inner end which is suitably connected, for example, by sewing, to the margin 26, such that the opening defined by margin 26 opens into elongated face tunnel 14. The opposite or distal edge of face tunnel 14 terminates in a tapered edge 30, the edge 30 tapering upwardly from the lower portion of the tunnel to its upper portion. Thus, tunnel 14 projects from margin 26 forwardly to protect the face of the individual from the effects of wind and also affords some heat retention characteristics to headwear 10.

Figure 3:
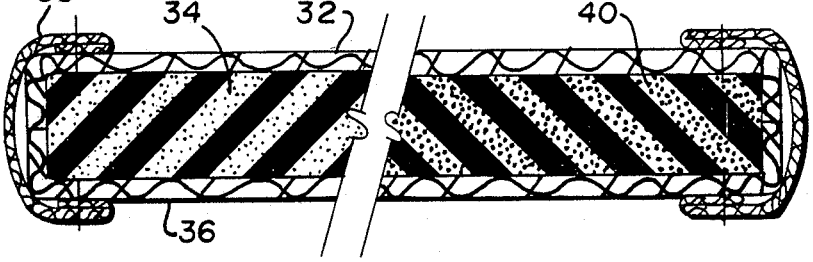

Referring now to FIG. 3, the materials forming the headgear and tunnel, 12 and 14, respectively, are illustrated. The material is the same for both headgear and tunnel, with certain exceptions, noted below. Essentially, three layers of material are provided: an inner layer 32, an intermediate layer 34 and an outer layer 36. In a preferred form of the present invention, the inner layer is formed of a material having minimum air permeability and a high moisture vapor transmission. Such material may be of the type manufactured by Burlington Industries, Inc., under the trademark Versatech ®. Particularly, such material has an air permeability of less than 15 $ft^3/min/ft^2$ at 0.5 inches head of water and a moisture vapor transmission rate of at least 1,000 $grams/meter^2/24$ hours. The intermediate layer 34 is formed of an open-cell polyurethane foam material. The outer layer 36 is formed of nylon and affords substantial wind resistance. As illustrated, the margins of this multilayer material are sewn together in the areas defining access opening 18 and neck 24. A knit binding 38 may be sewn with the edges of the multi-layer components to bind the margin and afford a smooth appearance.

It will be appreciated that the multi-layer material forming headgear 12 should be flexible for the comfort and fit of the individual wearer. However, the multilayer material defining the tunnel 14 should be stiffer than the material forming headgear 12 in order to be self-sustaining and prevent collapse from wind. To accomplish this, the material defining tunnel 14 is formed from inner and outer layers, simultaneously as the material comprising the inner and outer layers of the headgear 12. The intermediate layer 40 of face tunnel 14, however, is formed of an open-celled polyurethane foam having a density and indentation load-deflection value greater than the corresponding density and indentation load-deflection value of the foam 34 forming the intermediate layer of headgear 12. For example, and preferably, the density and indentation load-deflection value for the intermediate layer 34 for headgear 12 are 1.1 $lb/ft^3$ and 12 pounds, respectively. The intermediate layer 40 forming the tunnel 14 has a density and indentation load-deflection value of 1.8 $lbs/ft^3$ and 28 pounds, respectively, each layer 34 and 40 has a thickness of about one inch. Consequently, with this higher density foam intermediate layer forming a portion of the tunnel 14, the tunnel obtains a greater rigidity or stiffness in comparison with the more flexible nature of the material forming the headgear 12.

In this manner, tunnel 14 projects forwardly from the margins 26 about the face of the individual wearing headwear 10 and remains in a self-sustaining condition, open as illustrated in FIGS. 1 and 2. Also, it will not deflect laterally or downwardly under high wind conditions.

To further enhance the structural rigidity of the tunnel, a dart 41, as illustrated in FIG. 3*a*, is taken in along each side of the tunnel from the base where it attaches to headgear 12 about margin 26. Dart 41 extends outwardly along the tunnel a distance about one-third to one-half the length of the tunnel. The dart 41 acts as a corrugation and provides additional strength. Such darts 41 also make the tunnel more horizontally elliptical then round to improve side vision.

Referring back to FIG. 2, there is also provided a forehead shield 42 for protecting the individual's forehead from the cold. Forehead shield 42 extends downwardly from margin 26 adjacent the top of the facial opening of headgear 12 to a limited extent to overlie the individual's forehead. The material of the forehead shield may comprise similar materials as form headgear 12, with the exception that the intermediate foam layer may be of somewhat lesser thickness.

Referring now to the embodiment hereof illustrated in FIGS. 4 and 5, like reference numerals are applied to generally like parts, followed by the suffix a. In this form, headgear **12*a* and tunnel 14*a*** are formed of a multi-layered material, similarly as in the previous embodiment, with inner, intermediate and outer layers. The intermediate layer in this form is formed of an open-cell polyurethane foam having a similar density throughout. The outer layer is formed of the same material forming the inner layer of the previous embodiment. That is, the outer layer in this form may comprise the fabric manufactured by Burlington Industries, Inc., under the tradename Versatech®. The inner layer is preferably formed of a tricot inner lining.

In this form, access opening **18*a* is formed at the rear of headgear 12*a* by a margin 44 which completely encompasses access opening 18*a* and to which is secured an elastic material 46. The margin of elastic material 46 defines an opening with the margin 44 of headgear 12*a* adjacent the lower side of access opening 18*a*. The elastic material 46 may thus be stretched to permit the individual to draw headgear 12*a* over his head. When worn, it will be appreciated that headgear 12*a* substantially completely encompasses the individual's head, with the opening between the fabric 46 and the lower margin 44** serving only to accommodate the individual's neck.

Thus, it will be appreciated that the objectives of the present invention are fully accomplished in that there has been provided headwear for use in extreme cold weather and wind conditions which has low heat and high moisture vapor transmissivity, which fully encompasses the invididual's head to effect such protection, and, in one form, has improved constructions to prevent collapse of the face tunnel in the face of severe winds and increased protection for the individual's face.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Protective headwear for cold weather environments comprising:

headgear for enclosing an individual's head and having a margin along a front portion thereof defining an opening for the individual's face;

said headgear having an access opening remote from said front portion for receiving the individual's head;

means defining a tunnel having opposite ends and including wall portions therebetween perimetrically enclosing said tunnel between said ends, one of said ends being connected to said headgear about said margin such that said tunnel defining means projects forwardly from said headgear;

each of said headgear and said tunnel defining wall portions being formed of an interior lining, an intermediate layer of foam material, and an outer fabric layer, one of said outer fabric layer and said interior lining comprising a fabric having an air permeability of less than 15 cubic feet per minute per square foot at 0.5 inches head of water, and having a moisture vapor transmission rate of at least one thousand grams per square meter per 24 hours.

2. Protective headwear according to claim 1 wherein said one fabric is woven from a fine denier, multi-filament, synthetic yarn so that it has a high density.

3. Protective headwear according to claim 1 wherein said interior lining is formed of a nylon tricot and said one fabric constitutes said outer fabric layer.

4. Protective headwear according to claim 1 wherein said interior lining is formed of said one fabric and said outer layer is formed of nylon.

5. Protective headwear according to claim 1 wherein said headgear includes a closure flap for closing at least in part said access opening, said access opening being defined in part by said flap with said flap being disposed on the backside of said headgear opposite said margin for the opening for the individual's face, and means cooperating between said flap and said headgear for releasably closing said access opening.

6. Protective headwear according to claim 1 wherein said headgear includes an elastic band extending between marginal portions of said access opening enabling access into the interior of said headgear, said band extending along the backside of the individual's head.

7. Protective headwear according to claim 1 including means defining a corrugation in said intermediate foam layer along opposite sides of said tunnel to afford enhanced structural strength to said tunnel.

8. Protective headwear according to claim 1 including a dart taken in along said intermediate foam layer and along opposite sides of said tunnel to afford enhanced structure strength to said tunnel.

9. Protective headwear according to claim 8 wherein each of said darts extend from the margin of said headgear along opposite sides of said tunnel and terminates short of the distal end of said tunnel.

10. Protective headwear for cold weather environments comprising:

headgear for enclosing an individual's head and having a margin along a front portion thereof defining an opening for the individual's face;

said headgear having an access opening remote from said front portion for receiving the individual's head;

means defining a tunnel having opposite ends and including wall portions therebetween perimetrically enclosing said tunnel between said ends, one of said ends being connected to said headgear about said margin such that said tunnel defining means projects forwardly from said headgear;

each of said headgear and said tunnel defining wall portions being formed of an interior lining, an intermediate layer of foam material, and an outer fabric layer, the intermediate layer of said tunnel defining wall portions being formed of a foam having a higher indentation load-deflection value than the indentation load-deflection value of the foam forming the intermediate layer of said headgear and a value sufficient to provide stiffness to said tunnel defining means whereby the tunnel shape thereof may be substantially self-sustaining.

11. Protective headwear according to claim 10 wherein the intermediate layer of said headgear has an indentation load-deflection value of about 12 pounds and the intermediate layer of said tunnel defining wall portions has a load-deflection value of about 28 pounds with each foam layer having a thickness of about one inch.

12. Protective headwear according to claim 10 wherein the intermediate foam layer of said headgear is flexible to afford comfort in use.

13. Protective headwear according to claim 10 wherein the intermediate layer of said tunnel defining wall portions has a density greater than the density of the foam material forming the intermediate layer of said headgear and sufficiently whereby the tunnel shape thereof may be substantially self-sustaining.

14. Protective headwear according to claim 13 wherein the densities of the respective foams are about 1.1 pounds per cubic foot and about 1.8 pounds per cubic foot with each having a thickness of about one inch.

15. Protective headwear for cold weather environments comprising:

headgear for enclosing an individual's head and having a margin along a front portion thereof defining an opening about the individual's face;

said headgear having an access opening remote from said front portion for receiving the individual's head;

means defining a tunnel having opposite ends and including wall portions therebetween perimetrically enclosing said tunnel between said ends, one of said ends being connected to said headgear about said margin such that said tunnel defining means projects forwardly from said headgear;

said tunnel defining means being formed of a material stiffer than the material forming said headgear and sufficiently stiff whereby the tunnel shape thereof may be substantially self-sustaining;

each of said headgear and said tunnel defining wall portions being formed of an interior lining, an intermediate layer of foam material, and an outer fabric layer, the intermediate layer of said tunnel defining wall portions being formed of a foam having a higher indentation load-deflection value than the indentation load-deflection value of the foam forming the intermediate layer of said headgear and a value sufficient to provide stiffness to said tunnel defining means whereby the tunnel shape thereof may be substantially self-sustaining; and a forehead shield extending from said headgear beyond said margin adjacent the top of said opening and partially into the area of said tunnel.

16. Protective headwear according to claim 15 wherein one of said outer fabric layer and said interior lining comprises a fabric having an air permeability of less than 15 cubic feet per minute per square foot at 0.5 inches head of water, and having a moisture vapor transmission rate of At least one thousand grams per square meter per 24 hours.

17. Protective headwear according to claim 16 wherein said one fabric is woven from a fine denier, multi-filament, synthetic yarn so that it has a high density.

18. Protective headwear according to claim 17 wherein said interior lining is formed of a nylon tricot and said one fabric constitutes said outer fabric layer.

19. Protective headwear according to claim 18 wherein said intermediate layer is comprised of an open celled polyurethane foam.

20. Protective headwear according to claim 16 wherein said interior lining is formed of said one fabric and said outer layer is formed of nylon.

21. Protective headwear for cold weather environments comprising:

headgear for enclosing an individual's head and having a margin along a front portion thereof defining an opening about the individual's face;

said headgear having an access opening remote from said front portion for receiving the individual's head;

means defining a tunnel having opposite ends and including wall portions therebetween perimetrically enclosing said tunnel between said ends, one of said ends being connected to said headgear about said margin such that said tunnel defining means projects forwardly from said headgear;

said tunnel defining means being formed of a material stiffer than the material forming said headgear and sufficiently stiff whereby the tunnel shape thereof may be substantially self-sustaining; and a dart taken in along said intermediate foam layer and along opposite sides of said tunnel to afford enhanced structure strength to said tunnel.

22. Protective headwear according to claim 21 wherein each of said darts extend from the margin of said headgear along opposite sides of said tunnel and terminates short of the distal end of said tunnel.

23. Protective headwear for cold weather environments comprising:

headgear for enclosing an individual's head and having a margin along a front portion thereof defining an opening for the individual's face;

said headgear having an access opening remote from said front portion for receiving the individual's head;

means defining a tunnel having opposite ends and including wall portions therebetween perimetrically enclosing said tunnel between said ends, one of said ends being connected to said headgear about said margin such that said tunnel defining means projects forwardly from said headgear;

a forehead shield extending from said headgear beyond said margin adjacent the top of said opening and at least partially into the area defined by said tunnel;

each of said headgear and said tunnel defining means being formed of an interior lining, an intermediate layer of foam material, and an outer fabric layer, one of said interior lining and said outer fabric layer comprising a fabric having an air permeability of less than 15 cubic feet per minute per square foot at 0.5 inches head of water, and having a moisture vapor transmission rate of at least one thousand grams per square meter per 24 hours.

24. Protective headwear according to claim 23 wherein said interior lining is formed of a nylon tricot and said one fabric constitutes said outer fabric layer.

25. Protective headwear according to claim 23 wherein said inner lining is formed of said one fabric and said outer layer is formed of nylon.

26. Protective headwear for cold weather environments comprising:

headgear for enclosing an individual's head and having a margin along a front portion thereof defining an opening about the individual's face;

said headgear having an access opening remote from said front portion for receiving the individual's head;

means defining a tunnel having opposite ends and including wall portions therebetween perimetrically enclosing said tunnel between said ends, one of said ends being connected to said headgear about said margin such that said tunnel defining means projects forwardly from said headgear;

said tunnel defining means being formed of a material stiffer than the material forming said headgear and sufficiently stiff whereby the tunnel shape thereof may be substantially self-sustaining;

said headgear including a closure flap for closing at least in part said access opening; and means cooperating between said flap and said headgear for releasably closing said access opening.

27. Protective headwear for cold weather environments comprising:

headgear for enclosing an individual's head and having a margin along a front portion thereof defining an opening about the individual's face;

said headgear having an access opening remote from said front portion for receiving the individual's head;

means defining a tunnel having opposite ends and including wall portions therebetween perimetrically enclosing said tunnel between said ends, one of said ends being connected to said headgear about said margin such that said tunnel defining means projects forwardly from said headgear;

said tunnel defining means being formed of a material stiffer than the material forming said headgear and sufficiently stiff whereby the tunnel shape thereof may be substantially self-substaining; and means defining a corrugation in said intermediate foam layer along opposite sides of said tunnel to afford enhanced structural strength to said tunnel.

28. Protective headwear for cold weather environments comprising:

headgear for enclosing an individual's head and having a margin along a front portion thereof defining an opening for the individual's face;

said headgear having an access opening remote from said front portion for receiving the individual's head;

means defining a tunnel having opposite ends and including wall portions therebetween perimetrically enclosing said tunnel between said ends, one of said ends being connected to said headgear about said margin such that said tunnel defining means projects forwardly from said headgear;

each of said headgear and said tunnel defining wall portions being formed of an interior lining, an intermediate layer of foam material, and an outer fabric layer; and a forehead shield extending from said headgear beyond said margin adjacent the top of said opening and partially into the area of said tunnel.

* * * * *